US005755306A

United States Patent [19]

Kraemer et al.

[11] Patent Number: 5,755,306

[45] Date of Patent: May 26, 1998

[54] PERSONNEL LIFT INCORPORATING AN OUTREACH MECHANISM FOR AN AERIAL WORK PLATFORM

[75] Inventors: Matthew G. Kraemer; John Busuttil, both of Redmond, Wash.

[73] Assignee: Genie Industries, Inc., Redmond, Wash.

[21] Appl. No.: 676,976

[22] Filed: Jul. 8, 1996

[51] Int. Cl.[6] ..... E04G 21/00

[52] U.S. Cl. ..... 182/148; 182/62.5

[58] Field of Search ..... 182/148, 62.5, 182/69.5, 69.1, 69.6

[56] References Cited

U.S. PATENT DOCUMENTS

| | | | |
|---|---|---|---|
| 619,439 | 2/1899 | Riecke | 182/62.5 |
| 686,458 | 11/1901 | Johnson | 182/62.5 |
| 803,717 | 11/1905 | Schwarz | 182/62.5 |
| 2,354,905 | 8/1944 | Bacley | 182/148 |
| 2,953,229 | 9/1960 | Wiegel | 182/696 |
| 3,031,027 | 4/1962 | McKlell | 182/62.5 |
| 3,384,201 | 5/1968 | Fulton . | |
| 5,109,951 | 5/1992 | Lecorre . | |
| 5,487,446 | 1/1996 | Patnode et al. . | |

*Primary Examiner*—Alvin C. Chin-Shue

*Attorney, Agent, or Firm*—Christensen O'Connor Johnson & Kindness PLLC

[57] ABSTRACT

An outreach mechanism (34) for an aerial work platform (22) on a personnel lift (20). The outreach mechanism (34) is designed to attach an aerial work platform (22) to the upper section (24A) of a vertical lift assembly (24) of a personnel lift (20). The outreach mechanism (34) includes scissors-like arms (38, 40) that extend between the aerial work platform (22) and the upper section (24A) of the vertical lift assembly (24). The upper ends of the arms (38, 40) are pivotally attached to the aerial work platform (22) and to the vertical lift assembly (24) at pivot points (46, 48). The lower ends (50, 52) of the arms (38, 40) slidingly engage channels (42, 44) attached to the aerial work platform (22) and to the upper portion of the vertical lift assembly (24). One of the lower ends (50, 52) of the arms (38, 40), namely, the lower end (50) of the arm (38) mounted in the channel (42) adjacent the aerial work platform (22), is affixed to a continuous chain (66). Rotation of the chain (66) by a handle (86) causes the chain (66) to move, which causes the lower end (50) of the arm (38) to move upwardly or downwardly. As the lower end (50) of the arm (38) is moved upwardly or downwardly, the scissors elements (38, 40) move inwardly and outwardly, causing the aerial work platform (22) to move toward and away from the vertical lift assembly (24).

11 Claims, 5 Drawing Sheets

Fig. 5.
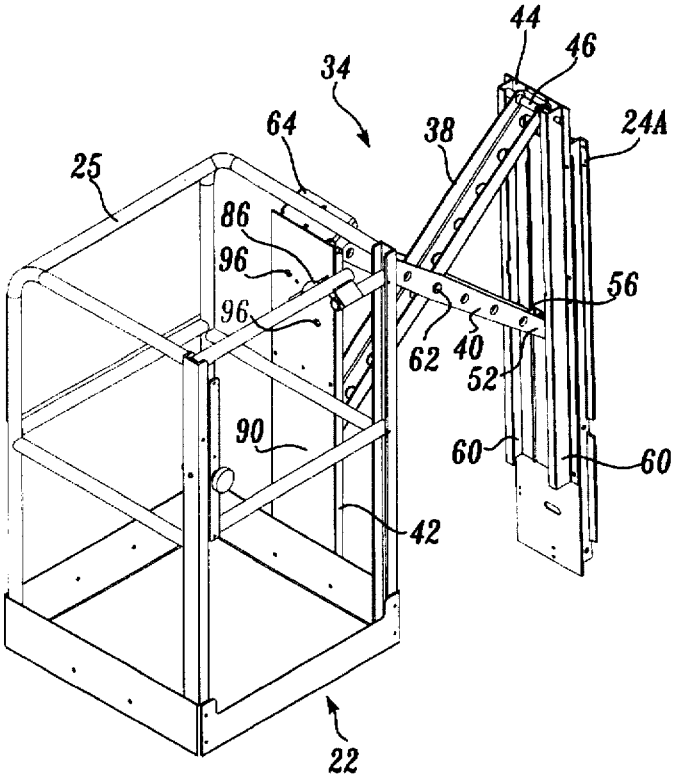
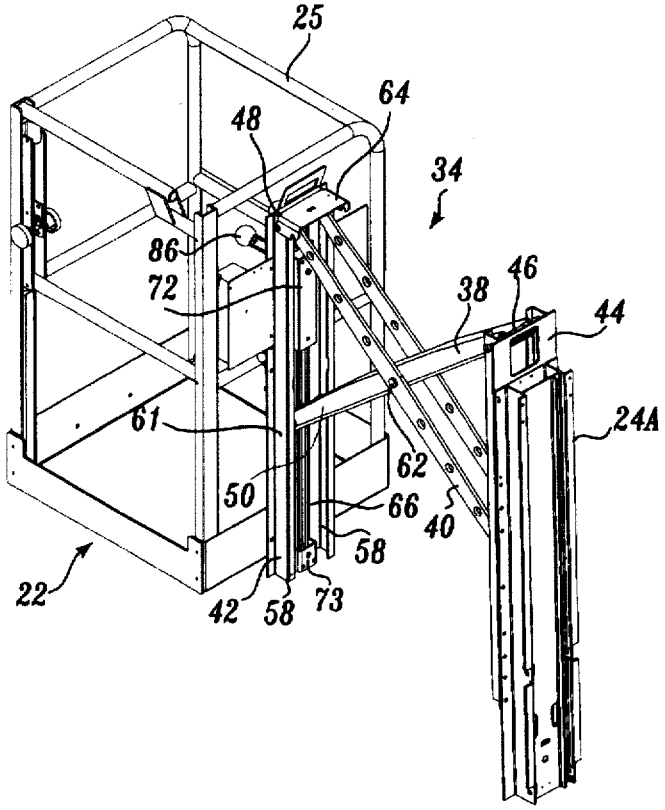
Fig. 6.

PERSONNEL LIFT INCORPORATING AN OUTREACH MECHANISM FOR AN AERIAL WORK PLATFORM

FIELD OF THE INVENTION

This invention is directed to personnel lifts, and more specifically, to personnel lifts incorporating an aerial work platform.

BACKGROUND OF THE INVENTION

Personnel lifts are presently used for a wide variety of applications. Personnel lifts generally include an aerial work platform that can be raised or lowered to position a worker at a desired height. Personnel lifts can be used within a plant to raise a worker to a position where the worker can change light bulbs, work on fixtures, or paint overhead surfaces, for example.

In one personnel lift design, the aerial work platform is attached to the upper end of a vertical lift assembly and includes a personnel cage for containing a worker. The vertical lift assembly includes a tower of extendible, nested columns mounted on a base supported by wheels. The tower and base are small so that a worker can easily roll the base to a desired location. Once the personnel lift is placed in the desired location, a number of outriggers are set to stabilize the base. A worker enters the personnel cage and operates controls to raise the aerial work platform.

A worker working in several overhead locations may find it necessary to move a personnel lift a number of times during the day. In general, once the aerial work platform is lifted to the desired height, the worker is limited to doing work in an area that is within arm's length of the aerial work platform. If the worker desires to do work beyond that reach, he or she must lower the aerial work platform, exit the personnel cage, release the outriggers from their secured position, and move the personnel lift to the next desired location. The outriggers must once again be set before the worker can return to the personnel cage and raise the aerial work platform to the desired height.

A worker utilizing prior art personnel lifts over an extended period of time may find the foregoing sequence of steps to be frustrating. An example is the painting of a roof or a roof truss member. Once the worker has painted everything within arm's length of the personnel cage, he or she must lower the aerial work platform, exit the personnel cage, release the outriggers from their secured position, move the personnel lift a little further down the roof or truss member, reset the outriggers, enter the personnel cage, and raise the platform back up to the desired height. Another example is a worker finding that an aerial work platform is inappropriately aligned after the worker is raised to change a light bulb or perform some other task. Again, the foregoing lowering, outrigger release, movement, outrigger reset and raising steps are required. Not only is this frustrating to the worker, it is expensive because of the lost time involved. It would be advantageous if such an aerial work platform were repositionable to better align a worker and/or to extend the worker's reach.

One manner of addressing the problem of having to move a personnel lift a number of times during a selected operation is to enlarge the size of the aerial work platform so that the worker is afforded a broader range of reach when lifted to the desired height. The disadvantage of this solution is that an enlarged aerial work platform may require additional outriggers or a larger base for the personnel lift. In addition, an enlarged aerial work platform may result in an unwieldy personnel lift, which may be difficult to manipulate around a plant or fit through doorways. Thus, this solution does not solve the need for a personnel lift that has both a small aerial platform and an extended reach.

Another limitation of present personnel lifts is that they generally do not allow access to an item that is directly above a floor obstacle. Typical personnel lifts, by design, raise the aerial work platform straight upward from the base. An operation that is to be performed above an obstacle on the floor may be unreachable by such personnel lifts. Therefore, there is a need for a personnel lift that can safely position a worker above a floor obstacle.

U.S. Pat. No. 3,384,201 to Fulton presents one manner of resolving the above-stated problems. The Fulton patent teaches a tree crop harvesting mechanism mounted on a truck bed. A boom structure is rotatably mounted to the truck bed by a suitable bearing structure. As a result, the boom is rotatable about a vertical axis.

The boom supports a carriage that is movable up and down the boom. The carriage supports a lazy tong assembly capable of moving in and out in a horizontal direction. Located at the other end of the lazy tong assembly is an aerial work platform having a personnel cage. Extension and retraction of the tong assembly moves the aerial work platform horizontally outward and away from the boom. The extension and retraction of the tong assembly is controlled by a hydraulic actuator. Extension and retraction of the shaft of the pneumatic actuator is controlled by the person located in the personnel cage tilting forward and backward.

The U.S. Pat. No. 5,109,951 to Lecorre discloses another method of extending an aerial work platform away from a vertical boom. The mechanism includes scissors-like elements whose position controls the horizontal position of the aerial work platform. As the inner set of scissors elements are moved upwardly and downwardly, a pin mounted in a track causes the aerial work platform to move inwardly and outwardly and around a curved surface.

Although the Fulton and Lecorre patents disclose effective devices for horizontally displacing an aerial work platform, the mechanisms used to displace the platforms are complicated, cumbersome and may be difficult, if not impossible, to add to a personnel lift having the small rolling base described above. Moreover, the connection of the aerial work platform to the boom in the structures is complex. The large number of movable parts results in a mechanism that may require frequent repairs. There is a need for a more efficient, reliable, and inexpensive mechanism for horizontally displacing a worker from the vertical boom of a personnel lift. The mechanism should be suitable for incorporation into a personnel lift that is small enough to be wheeled around by a user.

In summary, there is a need for a small personnel lift that permits manipulation of an aerial work platform to a larger number of overhead positions without movement of the base. There is a further need for a small personnel lift that offers extension of an aerial work platform over a floor barrier, or permits a worker to horizontally align the aerial work platform once the platform is raised.

SUMMARY OF THE INVENTION

In accordance with the present invention, an outreach mechanism for the aerial work platform of a personnel lift is provided. Briefly described, the outreach mechanism permits the aerial work platform to be moved horizontally outward from a vertical supporting column. The outward movement extends the reach of a worker on the aerial work platform. The outreach mechanism is manually operated from the aerial work platform, allowing the worker to quickly and efficiently move the aerial work platform to its desired location.

More particularly described, the present invention provides a personnel lift having a base, a lift assembly attached to the base and capable of extending along a vertical axis and an aerial work platform located at the upper end of the lift assembly. The personnel lift includes an outreach mechanism located between the upper end of the vertical lift assembly and the aerial work platform and a manually-driven mechanical system for operating the outreach mechanism to move the aerial work platform toward and away from the vertical lift assembly.

In accordance with other aspects of this invention, the outreach mechanism further includes a first arm having a first end and a second end, the first end being pivotally connected to the upper end of the vertical lift assembly, and the second end slidingly engaging the aerial work platform and a second arm having a first end and a second end, the first end being pivotally connected to the aerial work platform, and the second end configured for sliding engagement with the upper end of the vertical lift assembly, said second arm crossing said first arm. A pivot rod extends through the crossing point of the first arm and the second arm and the arms are configured such that operation of the manually-driven mechanical system causes sliding movement of the first arm along the aerial work platform, the sliding movement causing a corresponding sliding movement of the second arm along the upper portion of the vertical lift assembly, whereby the two sliding movements cause horizontal movement of the aerial work platform relative to the upper end of the vertical lift assembly.

In accordance with further aspects of this invention, the sliding engagement of the first arm along the personnel cage defines a path, and the manually-driven mechanical system includes a first sprocket, a second sprocket, and a continuous chain extending around and between the two sprockets in a plane that is parallel to the path. The second end of the first arm is linked to a portion of the chain whereby rotation of the chain around the sprockets causes the second end of the first arm to move upward or downward, which in turn causes the sliding motion of the two arms and thus causes the aerial work platform to move horizontally inward or outward relative to the upper end of the vertical lift assembly. The mechanical system further includes a handle fixed for rotation with the first sprocket and located within the personnel cage, whereby rotation of the handle causes the aerial work platform to move inward and outward.

BRIEF DESCRIPTION OF THE DRAWINGS

Other aspects and many of the attendant advantages of this invention will become more readily appreciated as the same becomes better understood by reference to the following detailed description, when taken in conjunction with the accompanying drawing, wherein:

FIG. 5 is a front side perspective view of the top column of the vertical lift assembly, the aerial work platform, and the outreach mechanism of the personnel lift of FIG. 1, with the outreach mechanism extended;

FIG. 6 is a rear side perspective view of the top column of the vertical lift assembly, the aerial work platform, and the outreach mechanism of FIG. 5;

DETAILED DESCRIPTION OF THE PREFERRED EMBODIMENT

Figure 1:
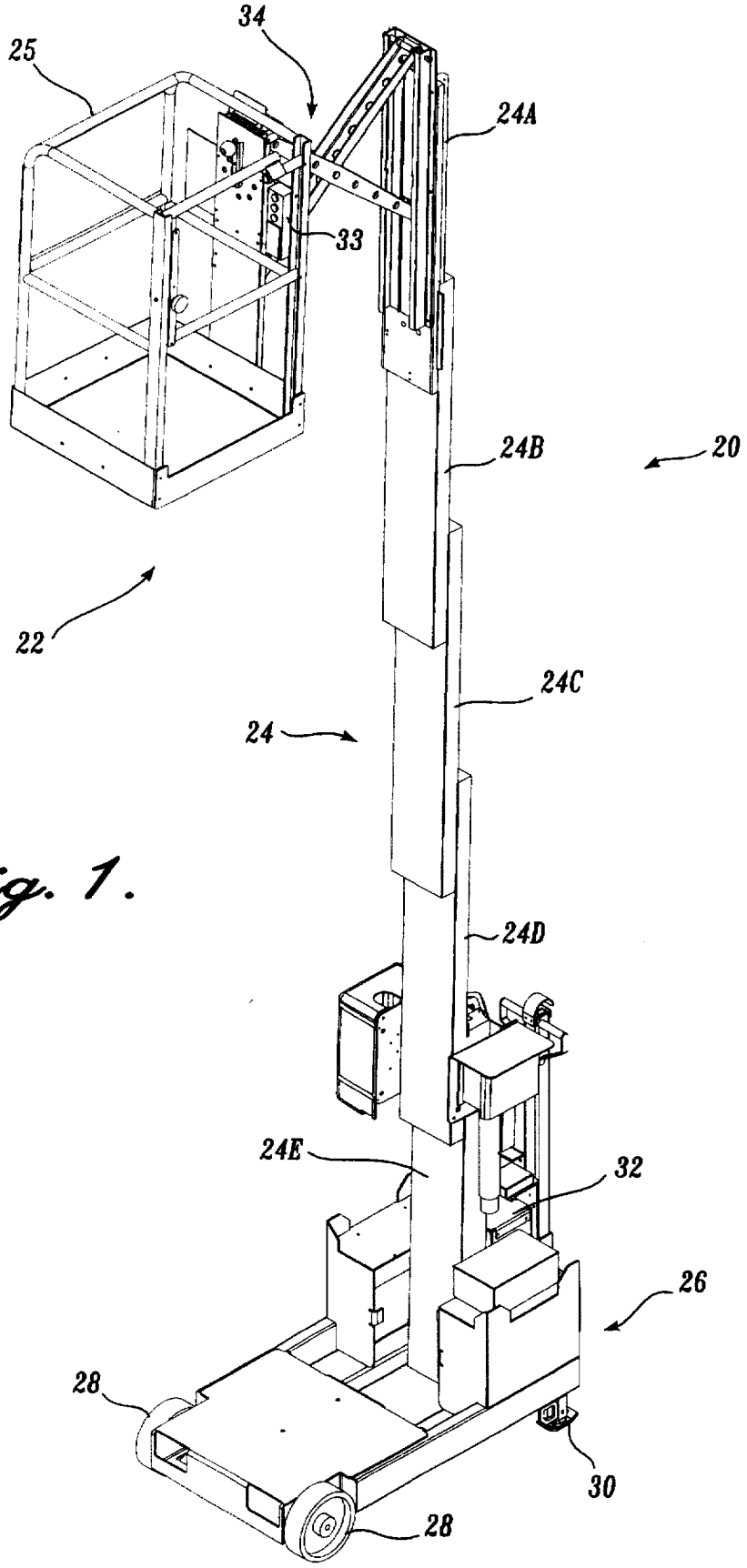
FIG. 1 discloses a side perspective view of a personnel lift incorporating an outreach mechanism for an aerial work platform embodying the present invention, with the vertical lift assembly in a raised position, and the outreach mechanism extended.

Referring now to the drawing, in which like reference numerals represent like parts throughout the several views, FIG. 1 illustrates a personnel lift 20 embodying the present invention. The personnel lift 20 includes an aerial work platform 22 attached to the upper column 24A of a vertical lift assembly 24, shown in the drawing as a vertical tower of nested, telescoping columns 24A–E. The aerial work platform 22 includes a personnel cage 25 in which a worker stands. The columns 24A–E are attached to a base 26 that includes wheels 28 for portability, and foot pads 30 for stability. A motor 32 is located at the rear of the vertical tower of nested, telescoping columns 24A–E.

Briefly described, the personnel lift 20 is moved to a desired location on the wheels 28. Once the location is reached, the foot pads 30 are set to give the base 26 stability. A worker then enters the personnel cage 25 and operates controls 33 (FIG. 1) located inside of the personnel cage 25 that control the energization of the motor 32 and other elements of a lift system (not shown, but well known in the art) that lift the personnel cage. The lift system may be hydraulic, a continuous chain system, or any other desired mechanism that causes the nested columns 24A–E to slide relative to one another so that they move into an end-to-end configuration, as shown in FIG. 1.

The operation and structure of the personnel lift 20 described thus far are known in the art. The configuration of the personnel lift shown in FIGS. 1 and 2 can be modified in manners well known to persons of skill in this art. For example, the maximum height of the vertical tower may be altered by varying the number or height of the individual columns 24A–E. A person of skill in this art will recognize that the size of the base 26 and the arrangement of the outriggers or foot pads 30 will be chosen to allow a worker to safely raise the aerial work platform 22 to its maximum height. An example of a personnel lift having the structure and operation described above is more fully described in U.S. Pat. No. 5,337,858, owned by the assignee of the present invention and incorporated herein by reference.

The present invention provides a novel outreach mechanism 34 for attaching the aerial work platform 22 to the upper column 24A of the vertical tower of nested columns 24A–E. Briefly described, the outreach mechanism 34 is designed to be manually operated by a worker located in the aerial work platform 22 to cause the aerial work platform 22 to move horizontally toward or away from the upper column 24A, as is shown by the arrow 35 in FIG. 2.

The outreach mechanism 34 includes a first arm 38 and a second arm 40 that extend between a channel 42 located on the back side of the personnel cage 25, and a channel 44, located on the front side of the upper column 24A. The second arm 40 is formed by a pair of links, one located on each side of the first arm 38. Thus, as can best be seen in FIGS. 5 and 6, the first arm 38 is configured to pivot within and be received by the second arm 40. Briefly described, the arms 38, 40 extend outward or fold over one another to form a "scissors" configuration to extend and retract the aerial work platform 22.

The first arm 38 is pivotally attached to the column channel 44 by a pivot rod 46 located at the top end of the column channel 44. Similarly, the second arm 40 is pivotally connected to a pivot rod 48 that is located at the upper end of the personnel cage channel 42. The lower ends 50, 52 of the arms 38, 40, respectively, are adapted to be slidably received within the channels 42, 44. In the embodiment shown, the lower ends 50, 52 include rollers 54, 56 (FIGS. 5 and 6) that are trapped between the bases of the channels, the legs 58, 60 of the channels 42, 44 and lips that face one another and are located along the outer edges of the legs 58, 60. A catch 61 that extends across the channel 42 defines an upper slide limit for the lower end 50 of the first arm 38.

To ensure coordinated movement and a perpendicular offset of the aerial work platform 22 from the vehicle lift assembly 24, the arms 38, 40 are the same length and pivotally connected at their centers by a pivot rod 62. By arranging the arms 38, 40 in this manner, the column channel pivot rod 46 is positioned adjacent to the personnel cage pivot rod 48 when the outreach mechanism 34 is "nonextended." A safety latch 64 pivotally connected to the personnel cage pivot rod 48 includes an opening 65 (FIG. 4) that is sized to receive the column channel pivot rod 46 when the outreach mechanism is nonextended.

Figure 7:
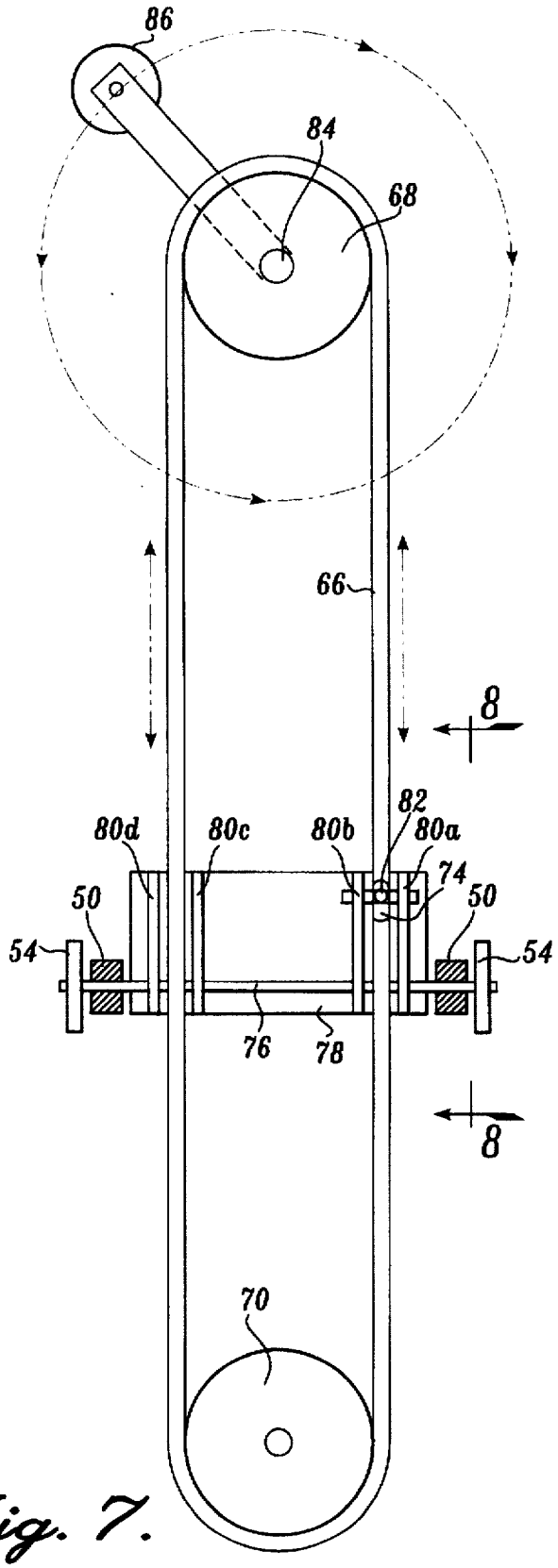
FIG. 7 is a schematic diagram showing the continuous chain included in the outreach mechanism for the personnel lift of FIG. 1.

A continuous chain 66 is located along the inside of the personnel cage channel 42. As can be seen in FIG. 7, the chain 66 extends between an upper sprocket 68 and a lower sprocket 70, both of which are rotatably mounted in the personnel cage channel. The upper sprocket 68 is encased in a first safety shield 72 (FIG. 6), and the lower sprocket 70 is enclosed in a second safety shield 73. A pin 82 extends through one of the links 74 in the chain 66 and through a first set of flanges 80*a*, 80*b* that lie on opposite sides of the chain 66. A second set of flanges 80*c*, 80*d* lie on opposite sides of the other run of chain in alignment with the first set of flanges 80*a* and 80*b*. The other run of chain is free to glide between these two flanges 80*c*, 80*d*. All of the flanges are affixed to and extend outwardly from a plate 78. As a result, movement of the link 74 causes movement of the flanges 80*a*, 80*b*, 80*c*, 80*d* and the plate 78.

An axle 76 that extends through the lower end 50 of the first arm 38 also extends through the flanges 80*a*, 80*b*, 80*c*, 80*d*. As a result, movement of the flanges 80*a*, 80*b*, 80*c*, 80*d* and the plate 78 causes movement of the axle 76. The axle 76 is rotationally connected to the lower end 50 of the first arm 38. The rollers 54 are mounted on the ends of the axle 76. This arrangement results in movement of the chain causing movement of the lower end 50 of the first arm 38 via the pin 82, and the flanges 80*a*, 80*b*, 80*c*, 80*d*. The plate 78 stiffens the overall assembly.

Figure 8:
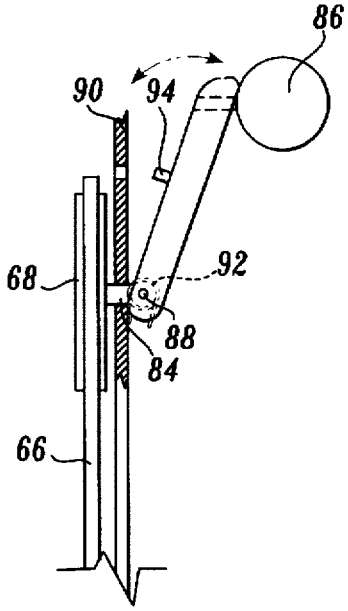
FIG. 8 is an elevational view along line 8—8 of FIG. 7.
Figure 9:
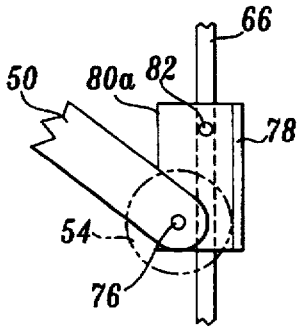
FIG. 9 is a side view of the handle included in the personnel lift of FIG. 1, the handle positioned outward at an operating position.

A rod 84 extends axially from one side of the upper sprocket 68 into the personnel cage 25 (see FIG. 8). More specifically, the rod 84 is mounted for rotation and the upper sprocket 68 is mounted on one end of the rod. As can be seen in FIG. 8, a handle 86 is located on the end of the rod and located in the personnel cage. The handle is pivotally attached to the rod 84 by a pin 88, such that the handle can be pulled out and away from the back side 90 of the personnel cage column 42. A spring clip 92 urges the handle 86 against the back side 90 of the channel 42. A protrusion 94, such as the head of a bolt, is provided on the back of the handle 86 and coacts with one of five holes 96 (FIG. 5) on the back side 90 of the channel 42 to prevent the handle from rotating unless the handle is pulled outwardly against the torque of the spring to a non-engaged position.

The operation of the outreach mechanism 34 for the aerial work platform 22 of the present invention can be understood with reference to the foregoing description. A worker rolls the personnel lift 20 using the wheels 28 to a desired location and, then, sets the foot pads 30 for stability. The worker then enters the personnel cage 25 and operates the controls 33 so that the motor 32 and lift system (not shown) raises the aerial work platform 22 to a desired height. While the work platform 22 is being raised, the channel 42 of the personnel cage 25 is against the channel 44 of upper column 24A, as shown in FIG. 3.

Once the columns 24A–E are extended to the desired height, the worker can horizontally move the personnel cage 25 away from the upper column 24A of the aerial work platform 20 by operating the handle 86. First, the safety catch 64 is lifted to disengage the opening 65 from the pivot rod 46. The handle 86 is then pulled outward from the back side 90 of the channel 42 to withdraw the protrusion 94 from one of the holes 96. The handle 86 is then rotated to move the aerial work platform 22 relative to the upper column 24A. Because the spring clip 92 biases the handle 86 against the back side 90 of the channel 42, it is necessary to pull outward on the handle while the handle is being rotated. Otherwise, the protrusion 94 on the back of the handle 86 will extend into one of the holes 96 on the back side 90 of the channel 42 as the handle is being rotated.

Figure 4:
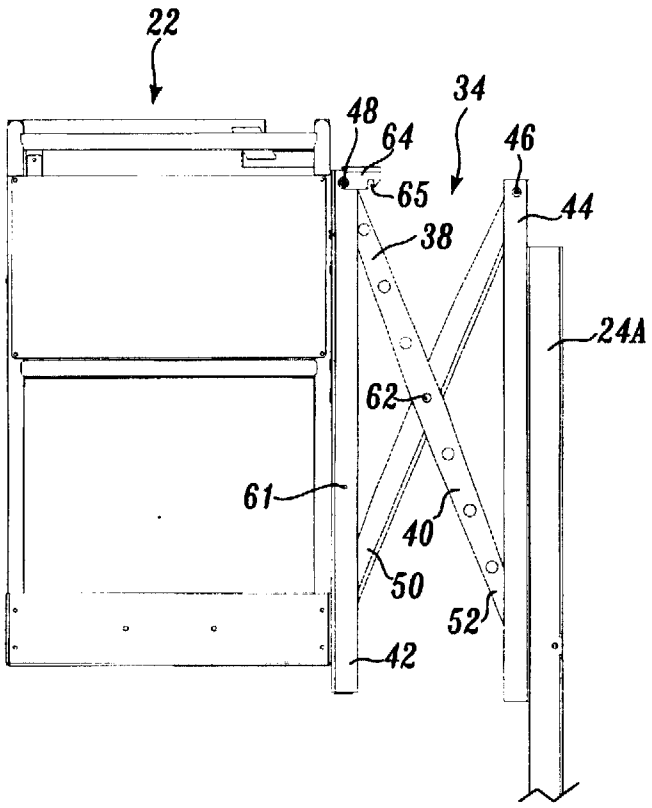
FIG. 4 is a side view of the aerial work platform and outreach mechanism of the personnel lift of FIG. 1, with the outreach mechanism shown partially extended.

When the handle 86 is rotated counterclockwise (FIG. 7), the upper sprocket 68 causes the chain 66 to rotate, which causes the plate 78 and, thereby, the lower end 50 of the first arm 38, to move upwardly. As the lower end 50 of the first arm 38 is moved upwardly, the scissors first arm 38 and the second arm 40 move the aerial work platform 22 outwardly, as shown in FIG. 4, away from the upper column 24A. The catch 61 limits the amount the lower end 50 of the first arm 38 can move upwardly and, thus, limits the extension of the aerial work platform 22. The fully extended position is shown in FIG. 2.

Figure 2:
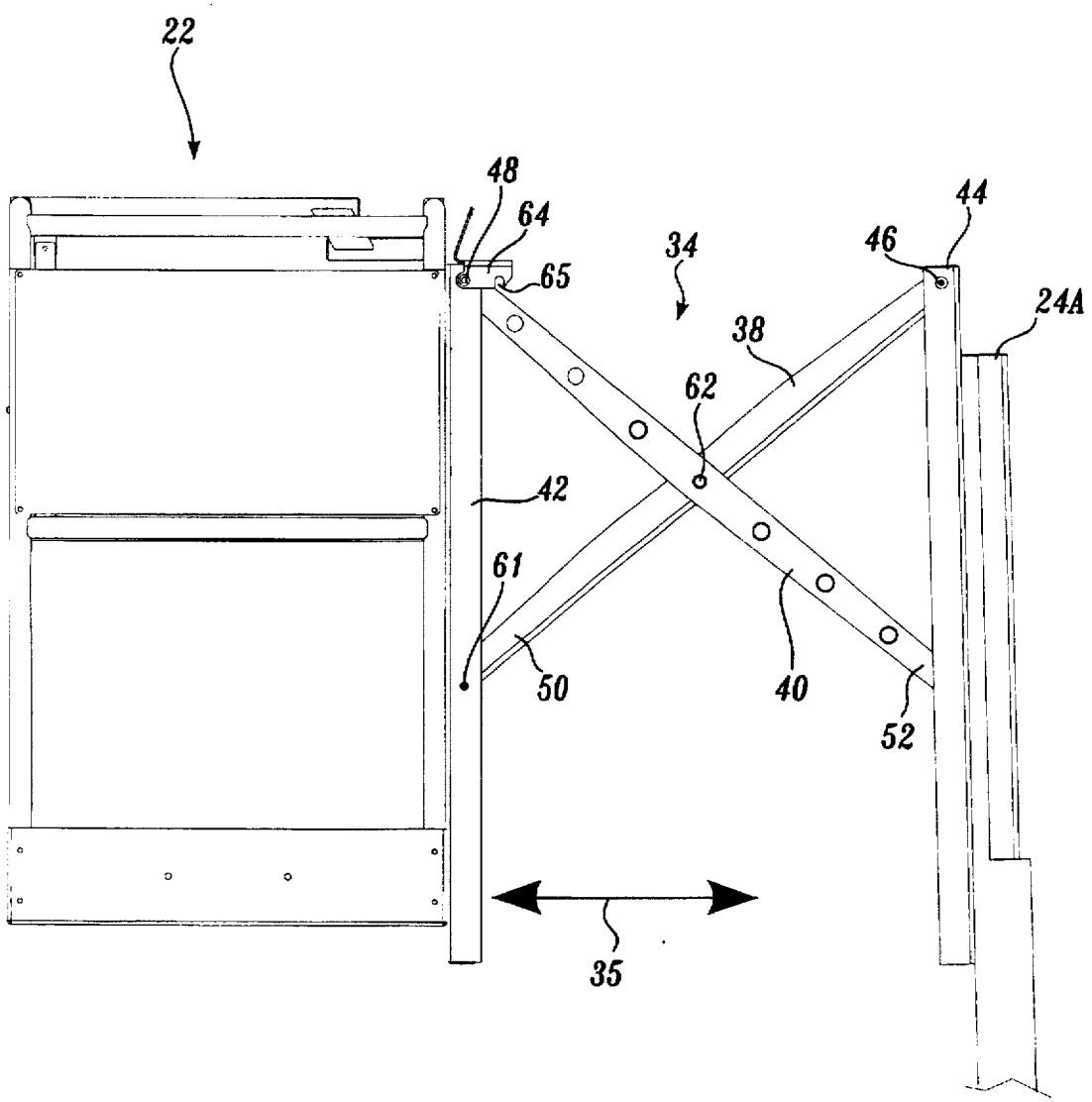
FIG. 2 is a side view of the aerial work platform and outreach mechanism of FIG. 1.
Figure 3:
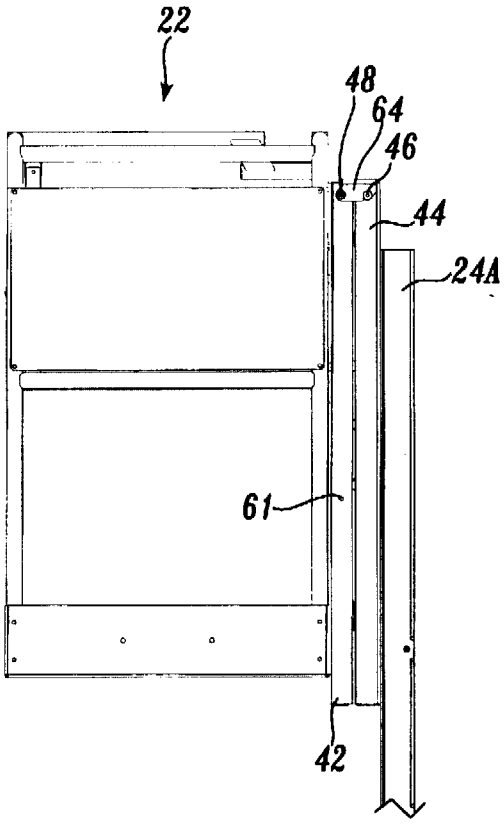
FIG. 3 is a side view of the aerial work platform and the outreach mechanism of the personnel lift of FIG. 1 with the outreach mechanism nonextended.

The aerial work platform 22 can be stopped at any location between the fully extended position shown in FIG. 2 and the nonextended configuration shown in FIG. 3. To lock the aerial work platform 22 at a desired position, the handle 86 is positioned such that the protrusion 94 is aligned with one of the holes 96. The spring clip 92 that biases the handle 86 toward the backside of the aerial platform channel 42 prevents the protrusion 94 from becoming disengaged from the holes 96 until the worker again pulls the handle 86 outward.

To return the aerial work platform 22 to the stowed position shown in FIG. 3, the handle 86 is rotated clockwise (FIG. 7) until the channel 42 of the personnel cage 25 is pressed against the channel 44 of the upper column 24A. The handle 86 is then positioned such that the protrusion 94 is aligned with one of the holes 96. The spring clip 92 that biases the handle presses the protrusion into the hole. The safety catch 64 is rotated so that the opening 65 is fitted over the pivot rod 46. A spring (not shown) may be supplied to bias the safety catch 64 into this locked position.

Preferably, the first arm 38 and the second arm 40 are substantially the same length, the pivot rods 46, 48 are located in the same horizontal plane, and the pivot rod 62 bisects the two arms. This configuration results in the aerial work platform 22 moving along a horizontal direction when the handle 86 is rotated. No lifting or lowering of the cage occurs. This configuration requires a minimum amount of work to turn the handle 86 and move the aerial work platform 22 inward and outward.

In the preferred embodiment of the invention, the outreach mechanism 34 is manually operated by the user, such as by the handle 86. Although the handle 86 may be replaced by a motor, gear, and switching assembly, or any other mechanism that is capable of performing the work of rotating the upper sprocket 68 in the desired manner, the addition of a motor or other drive systems to the personnel cage 25 or the upper column 24A may undesirably increase the weight at the upper end of the personnel lift 20, which must be taken into account when stabilizing the aerial work platform 20. Moreover, a motor, which must be supplied power at the top of the vertical lifting assembly 24, adds unnecessary cost, and may take needed space within the personnel cage 25. Therefore, it is preferred that the outreach mechanism 34 be manually operated.

The maximum outward extension of the aerial work platform 22 permitted by the outreach mechanism 34 must be taken into account when establishing the weight of the base 26 and designing the outriggers or foot pads 30. It is preferred that the aerial work platform 22 be located over the base 26 and extend outwardly by the outreach mechanism 34 over the base. However, it is to be understood that the aerial work platform 22 could extend away from the base if desired. Such a configuration will require an offset weight (not shown, but well-known in the art), in or on the base 26, or reconfiguration of the foot pads 30 or outriggers. Applicants have found that a 3-foot extension by the outreach mechanism 34 is optimal for stability and maneuverability of the aerial work platform 22. It is to be understood that the base 26 and the aerial work platform 20 may be configured and weighted such that the aerial work platform 22 could be safely extended a greater amount in a desired direction. A person of ordinary skill in the art will properly take into account the amount the aerial work platform 22 can be offset by the outreach mechanism 34 when determining the size, shape and weight of the base 26, and when designing the outriggers or foot pads 30.

While the presently preferred embodiment of the invention has been illustrated and described, it will be appreciated that various changes can be made therein without departing from the spirit and scope of the invention as defined by the appended claims.

The embodiments of the invention in which an exclusive property or privilege is claimed are defined as follows:

1. A personnel lift comprising:

a base;

a lift assembly attached to the base and capable of extending along a vertical axis, said lift assembly having an upper end;

an aerial work platform;

an outreach mechanism extending between the upper end of the vertical lift assembly and the aerial work platform, said outreach mechanism comprising:

a first arm having a first end and a second end, the first end being pivotally connected to the lift assembly, and the second end slidingly engaging the aerial work platform;

a second arm having a first end and a second end, the first end being pivotally connected to the aerial work platform, and the second end configured for sliding engagement with the lift assembly, said second arm crossing said first arm the second end of the second arm being substantially horizontally disposed to the second end of the first arm;

a pivot rod extending through the crossing point of the first arm and the second arm; and the arms being configured such that operation of the manually-driven mechanical system causes sliding movement of the first arm along the aerial work platform, the sliding movement causing a corresponding sliding movement of the second arm along the upper portion of the lift assembly, whereby the two sliding movements cause the aerial work platform to move substantially horizontally toward and away from the upper end of the lift assembly;

a manually-driven mechanical system located on the aerial work platform and attached to the second end of the first arm and for operating the outreach mechanism to move the aerial work platform toward and away from the upper end of the lift assembly.

2. The personnel lift of claim 1, wherein the sliding engagement of the first arm along the personnel cage defines a path, and wherein the manually-driven mechanical system comprises a first sprocket, a second sprocket, and a continuous chain extending around and between the two sprockets in a plane that is parallel to the path, and wherein the second end of the first arm is linked to a portion of the chain whereby rotation of the chain around the sprockets causes the second end of the first arm to move upward or downward, which in turn causes the sliding motion of the two arms and thus causes the aerial work platform to move toward and away from the upper end of the lift assembly.

3. The personnel lift of claim 2, wherein the mechanical system further comprises a handle fixed for rotation with the first sprocket and located within the personnel cage, whereby rotation of the handle causes the aerial work platform to move toward and away from the upper end of the lift assembly.

4. The personnel lift of claim 3, further comprising a flat plate comprising holes, extending along the path and located within the personnel cage, and wherein the handle further comprises a protrusion sized to be received in the hole and pivotally attached to the first sprocket such that the handle is capable of being arranged in two configurations, a first configuration in which the handle is spaced from the flat plate and is capable of rotating substantially parallel to the flat plate, and a second configuration in which, when the handle is aligned with the hole, the protrusion is received in the hole.

5. The personnel lift of claim 4, further comprising a plurality of holes in the flat plate and wherein the handle is capable of being rotated to be aligned with any of the holes, and the holes are arranged such that the protrusion on the handle is receivable in one of the holes when the handle is positioned in the second configuration.

6. The personnel lift of claim 4, wherein the handle is biased into the second configuration.

7. A personnel lift comprising:

a base;

a lift assembly attached to the base and capable of extending along a vertical axis and having an upper end;

an aerial work platform;

a first arm having a first end and a second end, the first end being pivotally connected to the vertical lift assembly, and the second end slidingly engaging the aerial work platform along a path;

a second arm having a first end and a second end, the first end being pivotally connected to the aerial work platform, and the second end configured for sliding engagement with the vertical lift assembly, said second arm crossing said first arm;

a pivot rod extending through the crossing point of the first arm and the second arm; and a mechanical system for operating the first and second arms to move the aerial work platform between first and second positions, the first position in which the aerial work platform is adjacent to the upper end of the vertical lift assembly, and the second position in which the aerial work platform is spaced outwardly from the longitudinal axis and away from the upper end, the mechanical system comprising an first sprocket, a second sprocket, a continuous chain extending around and between the two sprockets in a plane that is parallel to the path, and means for rotating the chain around the sprocket, and wherein the second end of one of the first and second arms is linked to a portion of the chain whereby rotation of the chain around the sprockets causes the second end of the one arm to move upward or downward, which in turn causes the sliding motion of the two arms and thus causes the aerial work platform to move inward or outward relative to the upper end of the lift assembly.

8. The personnel lift of claim 7, wherein the one arm is the first arm.

9. The personnel lift of claim 8, wherein the mechanical system is located substantially on the aerial work platform.

10. The personnel lift of claim 7, wherein the second position of the aerial work platform is substantially horizontally displaced from the first position of the aerial work platform.

11. The personnel lift of claim 7, wherein the means for rotating comprises a handle fixed for rotation with the first sprocket and located within the personnel cage, whereby rotation of the handle causes the aerial work platform to move inward and outward.

* * * * *